US005178165A

United States Patent [19]

DeFelice

[11] Patent Number: 5,178,165

[45] Date of Patent: Jan. 12, 1993

[54] SMOKERS DISPOSABLE MOUTHPIECE

[76] Inventor: Amedio DeFelice, 251 Florence St., Leominster, Mass. 01453

[21] Appl. No.: 734,883

[22] Filed: Jul. 24, 1991

[51] Int. Cl.[5] ..... A24F 7/04; A24F 13/02

[52] U.S. Cl. ..... 131/198.1; 131/187; 131/340

[58] Field of Search ..... 131/340, 198.1

[56] References Cited

U.S. PATENT DOCUMENTS

| | | | |
|---|---|---|---|
| 2,164,702 | 4/1939 | Davidson | 131/340 |
| 3,010,458 | 11/1961 | Lebert | 131/340 |
| 3,946,748 | 3/1976 | Frankfurt | 131/340 |
| 4,461,308 | 7/1984 | Le Cover . | |

FOREIGN PATENT DOCUMENTS

| | | | |
|---|---|---|---|
| 2199231 | 7/1988 | United Kingdom | 131/340 |

*Primary Examiner*—V. Millin
*Assistant Examiner*—J. Doyle
*Attorney, Agent, or Firm*—Charles R. Fay

[57] ABSTRACT

A filtered smoker's mouthpiece having three sections; means to hold a cigarette or cigar in line with a chamber holding a filter, and a mouth piece therefore, wherein the filter is originally of greater volume than the filter chamber and is flexible and compressable. The mouthpiece includes stops to provide space between the end of a smoking article and the filter.

1 Claim, 1 Drawing Sheet

FIG. 1
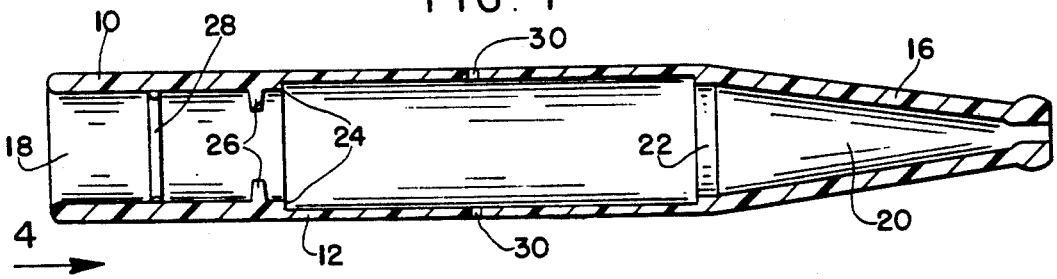
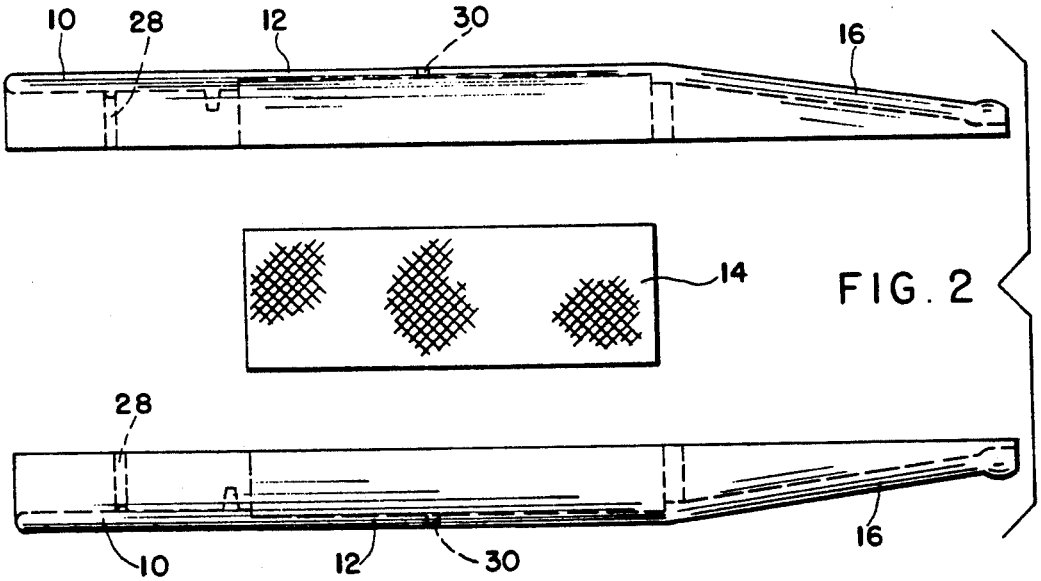
FIG. 2
FIG. 3
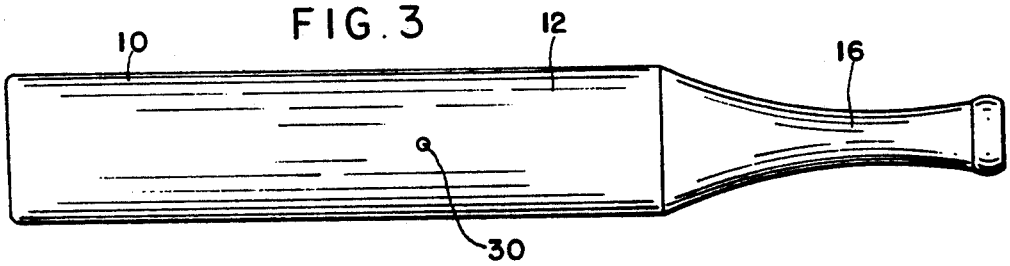
FIG. 4
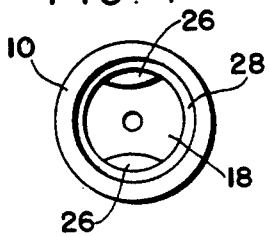

SMOKERS DISPOSABLE MOUTHPIECE

BACKGROUND OF THE INVENTION

The dangers of smoking tobacco have been known for many years, and many filter ideas and designs have been advanced. This type of protection has improved with the years and this invention continues the line of advancement in the art, in particular, the art of providing filters separate from the article being smoked.

SUMMARY OF THE DISCLOSURE

This invention provides a mass produced filter in a disposable cigarette mouth piece of small cost, so that a smoker can use as many as seems to be best to the smoker. The mouth piece is made in two like parts with the filter captured in the assembled device which comprises a mouth part, an intermediate filter chamber, and a receptacle for the end of the cigarette, similar in appearance to the well-known cigar mouth piece. This invention may also be made to use with cigars. The filter is positioned between the two halves of the device, the two halves are brought together and sonically welded.

The receptacle section of the device contains means for more firmly holding a cigarette and also for providing a separation or space between the proximate end of the cigarette and the filter. The filter chamber is originally formed considerably smaller than the natural volume of the filter, so that the filter will be compressed when inserted into the chamber, and provide greater filtering action. Also, a pair or more of very small holes are provided extending through the wall of the filter chamber for the admission of extra air to assist in the flow of smoke.

BRIEF DESCRIPTION OF THE DRAWINGS

FIG. 1 is a longitudinal sectional view through the new device;

FIG. 2 is an exploded elevational view illustrating the assembly of the device;

FIG. 3 is a top plan view thereof, and

FIG. 4 is an elevational view looking in the direction of arrow 4 in FIG. 1.

PREFERRED EMBODIMENT OF THE INVENTION

The subject smoker's mouthpiece is made of suitable plastic material molded in two like parts which are secured permanently together forming the device containing the filter. One part is shown in FIG. 1, wherein the one-half piece is shown as molded. Each one-half part has three main sections. Section 10 holds the cigarette or cigar; central section 12 holds the filter 14; and end section 16 is the mouth part. Section 10 is opened ended at 18; section 12 is essentially cylindrical and has a volume and shape to encase the filter which is also cylindrical. It will be noted from FIG. 2 that the filter 14 is considerably larger than the combined parts 12 forming the chamber for the filter. The filter 14 is made of a flexible, compressable material such as ordinarily used in devices of this nature, but may be foamed rubber or plastic or other flexible materials. The mouth end 16 has a restricted passage 20, for the smoke. A circular rib 22 is abutted by the filter at one end of the filter and another rib 24 abuts the filter at its opposite end. Two opposite truncated or part rib sections 26 abut the cigaret or cigar at its inner end slightly spaced from the filter.

The cigarette-holding section 10 is provided with an internal rib 28 which has an internal diameter slightly less than that of the usual cigarette, and this serves to more tightly hold the cigarette in position. The filter-holding chamber is provided with two or more air holes 30 which together admit some air flow into the chamber, thus improving the passage of smoke through the filter chamber 10 the smoker's mouth.

The two like parts are shown in FIG. 2 with the filter placed there-between, and the two mouth piece parts are brought together encasing the compressed filter within the chamber of sections 12. The two halves are then permanently secured by any convenient means such as by sonic welding. Automatic machinery can be devised to make the entire operation automated, and thereby produce very inexpensive articles that are disposable after use.

It will be noted that the wall of the filter chamber is thinner than the wall of the mouthpiece or the wall of the cigarette-receiving section.

I calim:

1. A disposable smoker's article comprising an open-ended section for receiving and holding a smoking article to be smoked, a filter chamber being open at both ends, and a generally flat portion for the mouth of the smoker, a filter in the chamber, the filter being larger in volume than the filter chamber and being flexible and compressible to fit into the filter chamber, and stops between the filter chamber and the section receiving the smoking article to provide a space between the end of the smoking article and the adjacent end of the filter.

* * * * *